US005885015A

United States Patent [19]

No et al.

[11] Patent Number: 5,885,015

[45] Date of Patent: Mar. 23, 1999

[54] DYE DONOR RIBBON CARTRIDGE HAVING A SHIELD AND METHOD FOR USE IN A PRINTER

[75] Inventors: Young No, Pittsford; John D. Delorme, Spencerport, both of N.Y.

[73] Assignee: Eastman Kodak Company, Rochester, N.Y.

[21] Appl. No.: 956,558

[22] Filed: Oct. 23, 1997

[51] Int. Cl.[6] ..... B41J 35/26

[52] U.S. Cl. ..... 400/247; 400/208; 400/250

[58] Field of Search ..... 400/208, 207, 400/246, 247, 248, 223, 250; 347/217; 242/582, 160.1, 160.2

[56] References Cited

U.S. PATENT DOCUMENTS

| | | | |
|---|---|---|---|
| 2,094,550 | 9/1937 | O'Halloran | 400/247 |
| 4,477,198 | 10/1984 | Bowlds et al. | 400/247 |
| 4,710,781 | 12/1987 | Stephenson | 400/247 |
| 4,856,923 | 8/1989 | Smith | 400/247 |
| 5,071,272 | 12/1991 | Bell | 400/208 |
| 5,527,120 | 6/1996 | Helinski | 400/247 |
| 5,536,094 | 7/1996 | Kondo | 400/247 |
| 5,584,587 | 12/1996 | Koike et al. | 400/246 |

FOREIGN PATENT DOCUMENTS

| | | | |
|---|---|---|---|
| 0 487 314 A1 | 11/1991 | European Pat. Off. . | |
| 6-15936 | 1/1994 | Japan | 400/247 |
| 6-64296 | 3/1994 | Japan | 400/247 |

OTHER PUBLICATIONS

IBM Technical Disclosure Bulletin, vol. 24, No. 11B, "Rapidly Exchangeable Wear–Resistant . . . ", Apr. 1982.

Young No, A Printer Adapted to Guide a Dye Donor Therein and Method Therefor; Oct. 23, 1997 (Attorney Docket 76332).

*Primary Examiner*—Christopher A. Bennett

*Attorney, Agent, or Firm*—Walter S. Stevens

[57] ABSTRACT

A dye donor cartridge and method for use in a printer. The cartridge comprises a dye donor ribbon formed into a roll. The dye donor ribbon has an end portion. A shield is attached to the end portion of the dye donor ribbon and surrounds the dye donor ribbon as the dye donor ribbon forms the roll. In this manner, the shield shields the dye donor ribbon from damage during handling of the ribbon roll. The dye donor ribbon roll including its shield is mountable on a supply spool, so that the dye donor ribbon unrolls from about the supply spool as the supply spool rotates. The shield preferably has a plurality of sprocket holes for engaging the sprockets of a take-up spool, so that the dye donor ribbon is precisely taken-up onto the take-up spool without "jamming" as the take-up spool rotates. An alternative embodiment of the invention comprises an encasement surrounding the shield as the shield surrounds the dye donor ribbon for enhancing protection of the dye donor ribbon roll during handling. The encasement has a slit for passage of the shield and the dye donor ribbon therethrough. Moreover, the encasement includes an integrally attached lip of predetermined shape and extending along the slit for separating the shield from the roll of dye donor ribbon and for guiding the shield through the slit.

22 Claims, 4 Drawing Sheets

DYE DONOR RIBBON CARTRIDGE HAVING A SHIELD AND METHOD FOR USE IN A PRINTER

BACKGROUND OF THE INVENTION

The present invention generally relates to printer cartridge apparatus and methods and more particularly relates to a dye donor ribbon cartridge and method for use in a printer, such that the dye donor ribbon is free of damage caused by handling and so that the dye donor ribbon does not "jam" in the printer.

In a typical thermal resistive printer, a dye donor ribbon containing a repeating series of frames of different color heat transferable dyes (e.g., yellow, cyan and magenta colors) is spooled on a dye donor supply spool. The dye donor ribbon, which is typically formed from a thin and flexible dye carrying substrate, is fed from the supply spool and rewound onto a take-up spool. The donor ribbon moves through a nip defined between a thermal resistive print head and a dye-absorbing dye receiver. The dye receiver is in turn supported by a platen disposed adjacent the print head.

That is, at the beginning of a printing cycle, the print head is lifted away from the platen roller to allow the dye receiver to be transported to and placed upon the platen. The dye receiver transport system may be a set of capstan rollers. The print head engages the dye ribbon and presses the dye ribbon against the dye receiver to form a dye ribbon/dye receiver media sandwich. In this regard, the receiver may be cut sheets of coated paper or transparency and the print head may comprise, for example, a plurality of thermal resistive heating elements. When predetermined ones of the heating elements are energized, the heating elements are heated. In the presence of such heat and pressure, dye from the dye ribbon transfers to the dye receiver. Density of the dye printed on the receiver is a function of the heat energy delivered from the heating elements to the dye ribbon. Such printers offer the advantage of "continuous tone" dye density transfer by varying the heat energy applied to the heating elements, thereby yielding a plurality of variable dye density image pixels onto the receiver.

However, in such printers, only the supply spool without the dye donor cartridge is available to the user of the printer. In such printers, the user mounts the supply spool onto the printer and hand-winds the leading portion of the dye donor ribbon on the take-up spool. Such printers has several disadvantages. For example, the print head could be damaged if the user touches the dye donor ribbon and deposits microscopic skin fragments onto the ribbon. In addition, because the user manually winds the ribbon onto the take-up spool, there is an increased chance that the user may deposit dirt and grease on the ribbon which in turn might damage the print head. Moreover, if the user should touch the ribbon and embed fingerprints on the ribbon, the fingerprints will be visible on the printed image, a highly undesirable result.

In addition, it is desirable to feed the donor ribbon from the supply spool to the take-up spool along a path precisely leading from the supply spool to the take-up spool so that the donor ribbon precisely aligns with the take-up spool without skew or significant wrinkling. Precisely aligning the donor ribbon with the take-up spool allows the take-up spool to take-up the donor ribbon without "jamming" on the take-up spool. Such jamming is undesirable because when the donor ribbon jams on the take-up spool, operation of the printer must be stopped and the jammed donor ribbon cleared before printing can continue.

A ribbon cassette accommodating an inked ribbon is disclosed in U.S. Pat. No. 5,584,587 titled "Ribbon Cassette And Video Printer For Use Therewith" issued Dec. 17, 1996 in the name of Takashi Koike, et al. According to this patent, a cassette has a take-up spool and a supply spool spaced apart from each other. A length of inked ribbon has opposite ends engaged with the supply spool and the take-up spool. However, this patent does not appear to disclose a dye donor ribbon cartridge and method for use in a printer, such that the dye donor ribbon is free of damage caused by handling and so that the dye donor ribbon does not "jam" in the printer.

Therefore, there has been a long-felt need to provide a dye donor ribbon cartridge and method for use in a printer, such that the dye donor ribbon is free of damage caused by handling and so that the dye donor ribbon does not "jam" in the printer.

SUMMARY OF THE INVENTION

The invention resides in a dye donor cartridge for use in a printer. The cartridge comprises a dye donor ribbon formed into a roll. The dye donor ribbon has an end portion. A shield is attached to the end portion of the dye donor ribbon and surrounds the dye donor ribbon as the dye donor ribbon forms the roll. In this manner, the shield shields the dye donor ribbon from damage.

More specifically, the invention comprises a dye donor cartridge for use in a printer having a rotatable dye donor ribbon supply spool and a rotatable dye donor ribbon take-up spool having a plurality of sprockets therearound. The dye donor ribbon, which has an end portion, is formed into a roll about the supply spool, so that the dye donor ribbon unrolls from about the supply spool as the supply spool rotates. A shield is attached to the end portion of the dye donor ribbon and surrounds the dye donor ribbon as the dye donor ribbon forms the roll. The shield protects the dye donor ribbon from damage. The shield has a plurality of sprocket holes for engaging the sprockets of the take-up spool, so that the sprockets engage the sprocket holes as the take-up spool rotates and so that the dye donor ribbon is precisely taken-up onto the take-up spool without "jamming" as the sprockets engage the sprocket holes. An alternative embodiment of the invention comprises an encasement surrounding the shield as the shield surrounds the dye donor ribbon for enhancing protection of the dye donor ribbon. The encasement has a slit for passage of the shield and the dye donor ribbon therethrough. Moreover, the encasement includes an integrally attached lip of predetermined shape and extending along the slit for separating the shield from the roll of dye donor ribbon and for guiding the shield and attached ribbon through the slit formed in the encasement.

An object of the present invention is to provide a dye donor ribbon cartridge and method for use in a printer, such that the dye donor ribbon is free of damage caused by handling and so that the dye donor ribbon does not "jam" in the printer.

A feature of the present invention is the provision of a shield surrounding a roll of dye donor ribbon and attached to an end portion of the ribbon.

Another feature of the present invention is the provision of an encasement surrounding the shield as the shield surrounds the roll of dye donor ribbon.

An advantage of the present invention is that use thereof allows damage-free handling of the dye donor cartridge.

Another advantage of the present invention is that use thereof avoids "jamming" of the dye donor ribbon in the printer.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

Figure 1:
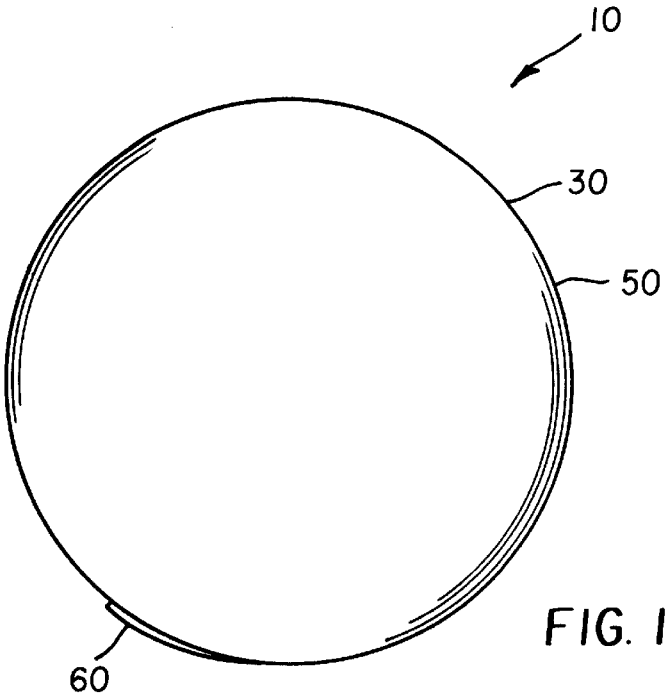
FIG. 1 is a plan view of a dye donor cartridge belonging to the present invention, the dye donor cartridge comprising a wound dye donor ribbon surrounded by a protective shield.

The present description will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3, 4, and 5, there is shown the subject matter of the present invention, which is a dye donor ribbon cartridge, generally referred to as 10, for use with a printer, generally referred to as 20. In this regard, printer 20 may be a thermal resistive printer of the type well known to those skilled in the printing arts. Cartridge 10 comprises a dye donor ribbon 30 having an integrally attached end portion 40 for reasons disclosed in detail hereinbelow. Ribbon 30 is flexible so that ribbon 30 may be formed into a roll 50. In this regard, ribbon 30 is preferably formed of a suitable polymer having dye therein. Attached, such as by a suitable adhesive, to end portion 40 is a shield 60 preferably formed of a polymer, such as polyethylene terephthalate. Shield 60 preferably has a tensile strength of 25,000 lb/in$^2$ ($1.73\times10^{-4}$ N/mm$^2$) and a thickness of approximately 0.25 mil in order to avoid inadvertent wrinkling or buckling of shield 60. It is important to avoid wrinkling or buckling of shield 60 for reasons provided hereinbelow. In addition, shield 60 is flexible and is sized so that shield 60 may be caused to surround ribbon 30 as ribbon 30 forms roll 50. In this regard, shield 60 surrounds ribbon 30 in order to protect ribbon 30 from damage. Such damage to ribbon 30 might be caused, for example, by inadvertently depositing finger marks, body oils, particulate matter, or the like onto ribbon 30 during handling of ribbon 30. It is important to avoid such damage because such damage may result in undesirably prints being produced by printer 20 or injury to print head 250 (see FIG. 4).

Figure 2:
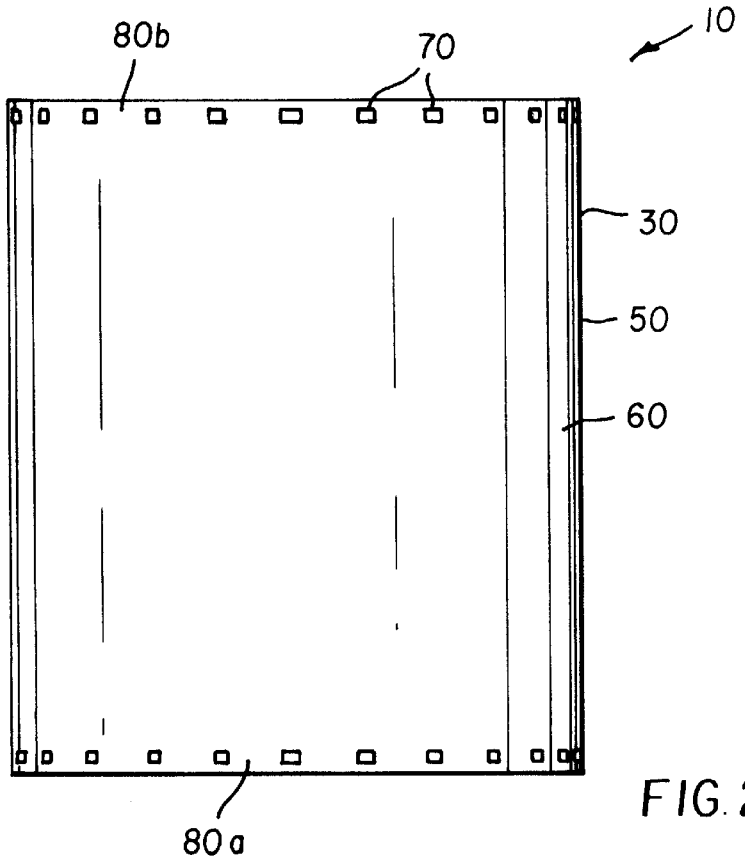
FIG. 2 is a view in elevation of the dye donor cartridge.
Figure 3:
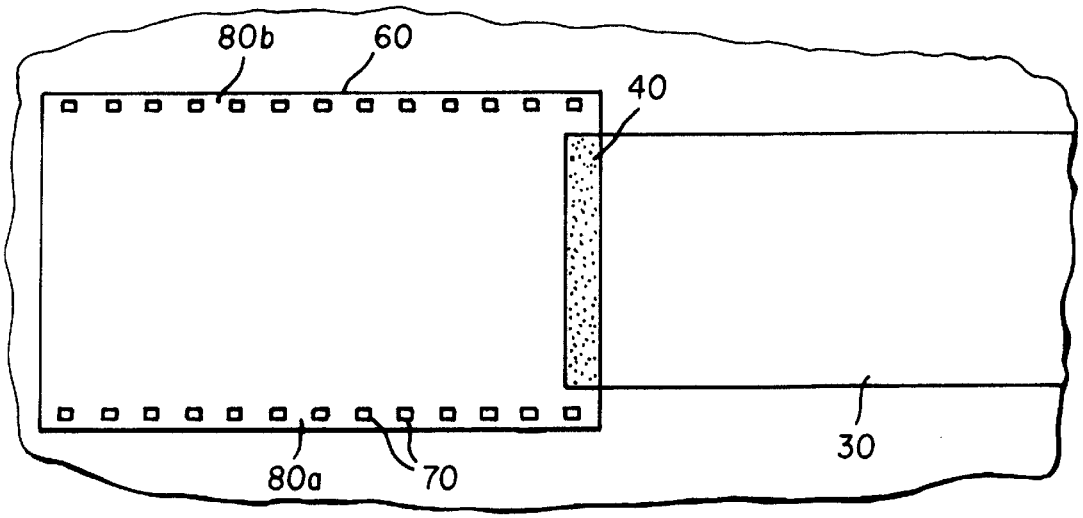
FIG. 3 is an enlarged fragmentation view of the shield attached to an end portion of the dye donor ribbon illustrated in an unwound state.
Figure 4:
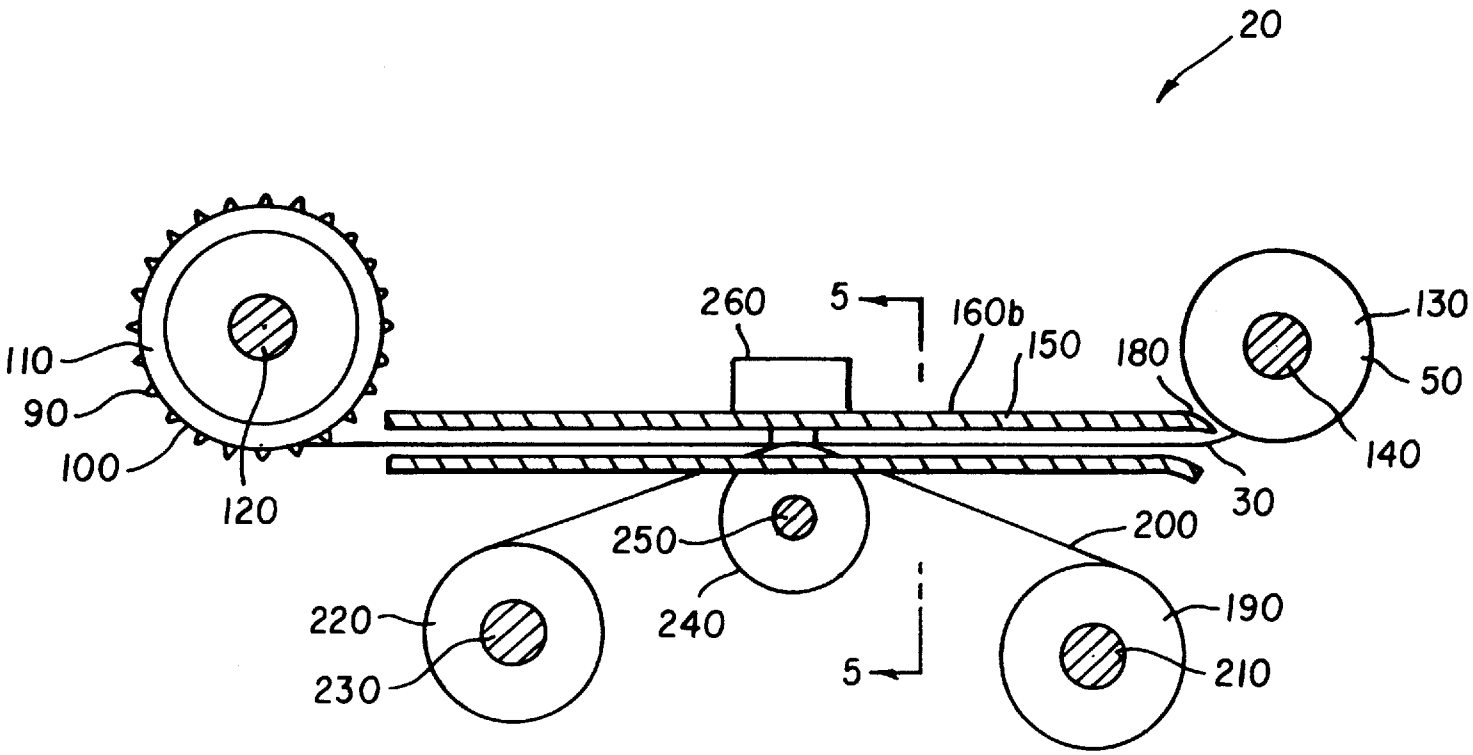
FIG. 4 is a view in partial vertical section of a printer in which the dye donor cartridge is usable.

Referring to FIGS. 2, 3 and 4, shield 60 has a plurality of sprocket holes 70 spaced along a pair of parallel marginal edge portions 80*a* and 80*b* belonging to shield 60. The purpose of sprocket holes 70 is to engage a plurality of sprockets 90 surrounding a circumference 100 defined by a dye donor ribbon take-up spool 110 belonging to printer 20, which take-up spool 110 is mounted for rotation on a take-up spindle 120. Ribbon take-up spool 110 is spaced-apart from a dye donor supply spool 130 comprising roll 50 of ribbon 30 when roll 50 is disposed in printer 20. In this regard, roll 50 is mounted for rotation on a supply spindle 140 so as to form supply spool 130. It may be appreciated that shield 60 preferably has a tensile strength of 25,000 lb/in$^2$ ($1.73\times10^{-4}$ N/mm$^2$) and a thickness of approximately 0.25 mil in order to avoid inadvertent wrinkling or buckling of shield 60. It is important to avoid wrinkling or buckling of shield 60, so that sprockets 90 will readily engage sprocket holes 70.

Figure 5:
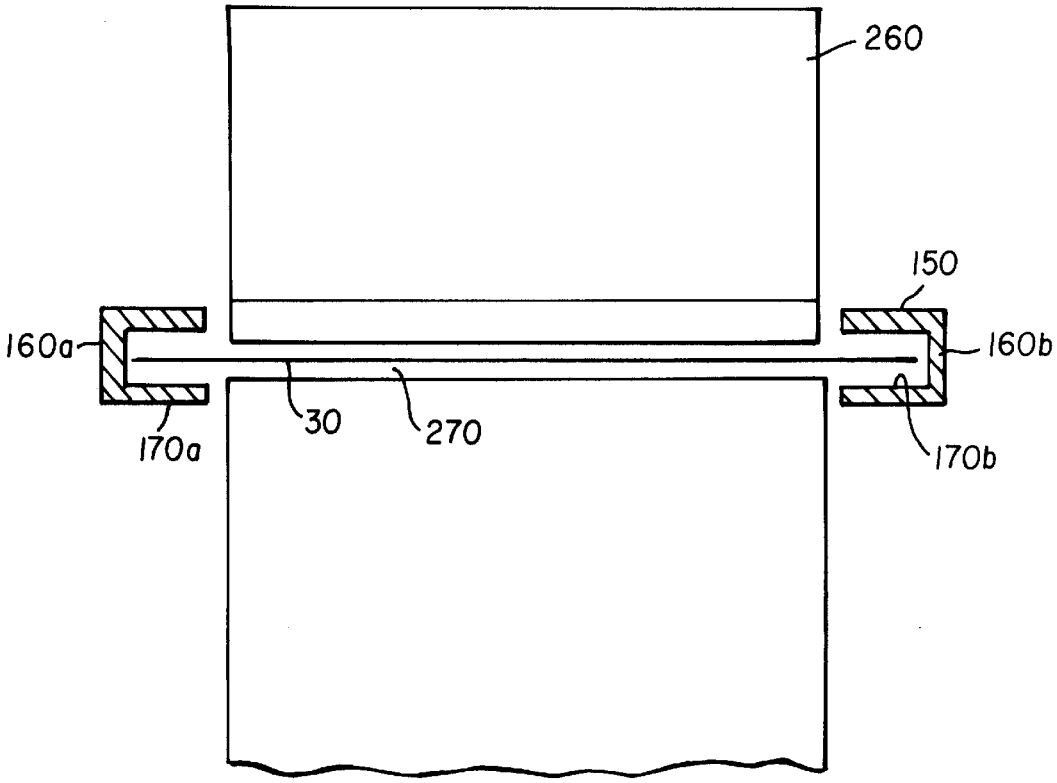
FIG. 5 is a view along section line 5—5 of FIG. 4.

Referring to FIGS. 4 and 5, printer 20, in which cartridge 10 is usable, may include a rail assembly 150 extending between supply spool 130 and take-up spool 110 for guiding ribbon 30 from supply spool 130 to take-up spool 110. More specifically, rail assembly 150 includes a pair of spaced-apart oppositely disposed parallel guide rails 160*a* and 160*b*, each guide rail 160*a*/*b* defining a passage 170*a* and 170*b*, respectively, for precisely guiding shield 60 (and therefore ribbon 30) from supply spool 130 to take-up spool 110. Precisely guiding shield 60 from supply spool 130 to take-up spool 110 is important in order to properly align sprocket holes 70 with sprockets 90. Proper alignment of sprocket holes 70 with sprockets 90 allows sprockets 90 to engage sprocket holes 70 without "jamming" of shield 60 is taken-up by take-up spool 110. Moreover, each guide rail 160*a*/*b* may include an end portion 180 of predetermined shape for intimately engaging shield 60 in order to peel shield 60 from roll 50 and thereafter precisely guide shield 60 into passages 170*a*/*b* as supply spindle 140 rotates roll 50. Of course, printer 20 may include a receiver supply reel 190 having a supply of receiver 200 (e.g., paper or transparency) would thereabout, which supply reel 190 may be mounted for rotation on a supply motor shaft 210. Spaced-apart from supply reel 190 is a receiver take-up reel 220 mounted for rotation on a take-up shaft 230. In this manner, receiver 200 extends from supply reel 190 to take-up reel 220. Interposed between supply reel 190 and take-up reel 220 may be a platen roller 240 for supporting receiver 200 thereon. Platen roller 240 may be freely rotatable about a platen roller shaft 250. Alternatively, platen roller 240 may be motor driven by means of a motor (not shown) engaging shaft 250 for assisting movement of receiver 200 from supply reel 190 to take-up reel 220. Moreover, disposed opposite platen roller 240 and interposed between dye donor ribbon supply spool 130 and dye donor ribbon take-up spool 110 is a print head 260 for forming an image on receiver 200. Print head 260 and platen roller 240 are disposed so as to define a clearance or nip 270 sized to accommodate ribbon 30 and receiver 200 as ribbon 30 and receiver 200 extend between platen roller 240 and print head 260. Thermal resistive print head 260 is capable of being suitably activated in a manner well known in the art to transfer dye therein to receiver 200, which is supported by platen roller 240.

Figure 6:
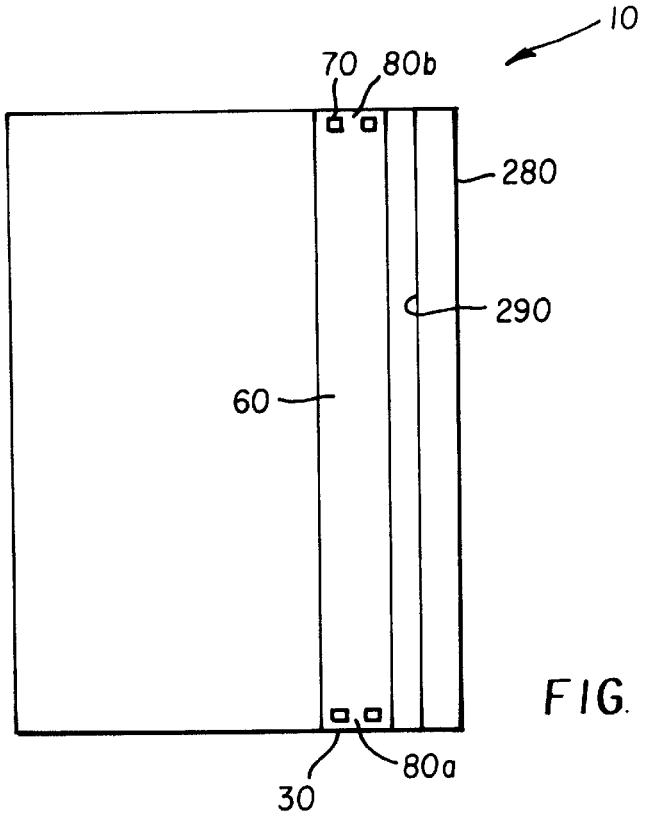
FIG. 6 is a view in elevation of an alternative embodiment of the dye donor cartridge.
Figure 7:
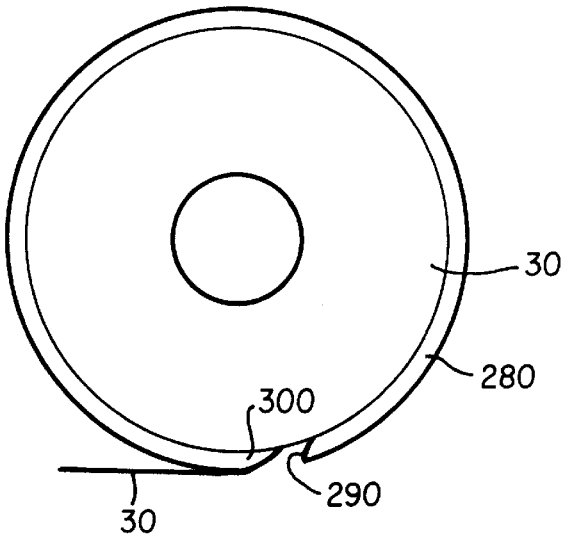
FIG. 7 is a plan view of the alternative embodiment of the dye donor cartridge.

Referring now to FIGS. 6 and 7, there is shown an alternative embodiment of cartridge 10. In this alternative embodiment of the invention, an encasement 280 surrounds shield 60, as shield 60 surrounds ribbon roll 50. Encasement 280 includes a slit 290 extending longitudinally in encasement 280 for passage of shield 60 and ribbon 30 through slit 290. A lip 300 is preferably integrally attached to encasement 280 and extends adjacently along slit 290 for peeling shield 30 from roll 50 and for guiding shield 30 through slit 290 as roll 50 rotates on spindle 140. It may be appreciated that encasement 280 should not rotate as roll 50 rotates. If encasement 280 should rotate as roll 50 rotates, shield 30 will not properly separate from roll 50. Therefore, encasement 280 has significantly greater mass (e.g., at least twice the mass of roll 50) than roll 50, so that encasement 280 will not rotate as roll 50 rotates. The purpose of encasement 280 is to enhance protection of ribbon roll 50 during handling of ribbon roll 50.

It is appreciated from the teachings herein that an advantage of the present invention is that use thereof allows damage-free handling of dye donor cartridge 10. This is so because shield 60 surrounds roll 50 of dye donor ribbon 30. Moreover, encasement 280 may surround shield 60, if desired, as shield 60 surrounds roll 50 for enhancing protection of ribbon 30.

Another advantage of the present invention is that use thereof avoids "jamming" of dye donor ribbon 30 in printer 20. This is so because sprocket holes 70 are provided in shield 60 for precisely engaging sprockets 90 of take-up spool 10. In this manner, ribbon 30 easily winds about take-up spool 110 without "jamming" on take-up spool and without having to manually wind ribbon 30 about take-up spool 110.

The invention has been described in detail with particular reference to certain preferred embodiments thereof, but it will be understood that variations and modifications can be effected within the spirit and scope of the invention. For example, receiver take-up reel 220 may be provided with sprockets 90 for engaging sprocket holes (not shown) formed along perforated break-away marginal edges of receiver 200 for precisely taking-up receiver 20 without "jamming" of receiver 200 on receiver take-up reel 220.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a dye donor ribbon cartridge and method for use in a printer, such that the dye donor ribbon is free of damage caused by handling and so that the dye donor ribbon does not "jam" in the printer.

PARTS LIST

10 . . . dye donor cartridge
20 . . . printer
30 . . . dye donor ribbon
40 . . . end portion (of ribbon 30)
50 . . . roll of dye donor ribbon
60 . . . shield
70 . . . sprocket holes
80*a/b* . . . end portions
90 . . . sprockets
100 . . . circumference
110 . . . dye donor ribbon take-up spool
120 . . . take-up spindle
130 . . . dye donor supply spool
140 . . . supply spindle
150 . . . rail assembly
160*a/b* . . . guide rails
170*a/b* . . . passages
180 . . . end portion
190 . . . receiver supply reel
200 . . . receiver
210 . . . shaft
220 . . . receiver take-up reel
230 . . . shaft
240 . . . platen roller
250 . . . shaft
260 . . . print head
270 . . . nip
280 . . . encasement
290 . . . slit
300 . . . lip

What is claimed is:

1. For use in a printer, a dye donor cartridge, comprising:

(a) a dye donor ribbon formed into a roll, said dye donor ribbon having an end portion; and (b) a shield attached to the end portion of said dye donor ribbon and surrounding said dye donor ribbon as said dye donor ribbon forms the roll for shielding said dye donor ribbon from damage.

2. The cartridge of claim 1, further comprising an encasement surrounding said shield as said shield surrounds said dye donor ribbon.

3. For use in a printer having a rotatable spool having a sprocket, a dye donor cartridge, comprising:

(a) a dye donor ribbon formed into a roll, said dye donor ribbon having an end portion; and (b) a shield attached to the end portion of said dye donor ribbon and surrounding said dye donor ribbon as said dye donor ribbon forms the roll for shielding said dye donor ribbon from damage, said shield having a sprocket hole for engaging the sprocket, so that said dye donor ribbon is taken-up onto the spool as the spool rotates.

4. The cartridge of claim 3, further comprising an encasement surrounding said shield as said shield surrounds said dye donor ribbon, said encasement having an opening for passage of said shield therethrough.

5. The cartridge of claim 4, wherein said encasement comprises a lip integrally attached thereto and extending adjacent to the opening for guiding said shield through the opening.

6. The cartridge of claim 3, wherein said shield is formed of polyethylene terephtahalate.

7. For use in a printer having a rotatable first spool and having a rotatable second spool having a plurality of sprockets therearound, a dye donor cartridge, comprising:

(a) a dye donor ribbon formed into a roll about the first spool, so that said dye donor ribbon unrolls from about the first spool as the first spool rotates, said dye donor ribbon having an end portion;

(b) a shield attached to the end portion of said dye donor ribbon and surrounding said dye donor ribbon as said dye donor ribbon forms the roll about the first spool for shielding said dye donor ribbon from damage, said shield having a plurality of sprocket holes for engaging the sprockets of the second spool, so that the sprockets engage the sprocket holes as the second motor rotates and so that said dye donor ribbon is taken-up onto the second spool as the sprockets engage the sprocket holes.

8. The cartridge of claim 7, further comprising an encasement surrounding said shield as said shield surrounds said dye donor ribbon, said encasement having a slit for passage of said shield and said dye donor ribbon therethrough.

9. The cartridge of claim 8, wherein said encasement comprises a lip of predetermined shape integrally attached thereto and extending along the slit for guiding said shield through the slit.

10. The cartridge of claim 7, wherein said shield is formed of polyethylene terephthalate.

11. The cartridge of claim 7, wherein said shield has a predetermined tensile strength of 25,000 lb/in$^2$, so that said shield is buckle-free as the sprockets engage the sprocket holes.

12. A method of providing a dye donor cartridge for use in a printer, comprising the steps of:

(a) forming a dye donor ribbon into a roll, the dye donor ribbon having an end portion; and (b) attaching a shield to the end portion of the dye donor ribbon; and (c) shielding the dye donor ribbon from damage by surrounding the dye donor ribbon with the shield as the dye donor ribbon forms the roll.

13. The method of claim 12, further comprising the step of surrounding the shield with an encasement as the shield surrounds the dye donor ribbon.

14. A method of providing a dye donor cartridge for use in a printer having a rotatable spool having a sprocket, comprising the steps of:

(a) forming a dye donor ribbon into a roll, the dye donor ribbon having an end portion;

(b) attaching a shield to the end portion of the dye donor ribbon; and (c) shielding the dye donor ribbon from damage by surrounding the dye donor ribbon with the shield as the dye donor ribbon forms the roll, the shield having a sprocket hole for engaging the sprocket, so that the dye donor ribbon is taken-up onto the spool as the spool rotates.

15. The method of claim 14, further comprising the step of surrounding the shield with an encasement as the shield surrounds the dye donor ribbon, the encasement having an opening for passage of the shield therethrough.

16. The cartridge of claim 15, wherein the step of surrounding the shield with an encasement comprises the step of integrally attaching a lip to the encasement, the lip extending adjacent to the opening for guiding the shield through the opening.

17. The method of claim 14, wherein the step of attaching a shield to the end portion comprises the step of attaching a shield formed of polyethylene terephthalate.

18. A method of providing a dye donor cartridge for use in a printer having a rotatable first spool and having a rotatable second spool having a plurality of sprockets therearound, the method comprising the steps of:

(a) forming a dye donor ribbon into a roll about the first spool, so that the dye donor ribbon unrolls from about the first spool as the first spool rotates, the dye donor ribbon having an end portion;

(b) attaching a shield attached to the end portion of the dye donor ribbon; and (c) shielding the dye donor ribbon from damage by surrounding the dye donor ribbon with the shield as the dye donor ribbon forms the roll about the first spool, the shield having a plurality of sprocket holes for engaging the sprockets of the second spool, so that the sprockets engage the sprocket holes as the second motor rotates and so that the dye donor ribbon is taken-up onto the second spool as the sprockets engage the sprocket holes.

19. The method of claim 18, further comprising the step of surrounding the shield with an encasement as the shield surrounds the dye donor ribbon, the encasement having a slit for passage of the shield and the dye donor ribbon therethrough.

20. The method of claim 19, wherein the step of surrounding the shield with an encasement comprises the step of integrally attaching a lip of predetermined shape to the encasement, the lip extending along the slit for guiding the shield through the slit.

21. The cartridge of claim 18, wherein the step of attaching a shield to the end portion comprises the step of attaching a shield formed of polyethylene terephthalate.

22. The cartridge of claim 18, wherein the step of attaching a shield to the end portion comprises the step of attaching a shield having a predetermined tensile strength of 25,000 lb/in$^2$, so that the shield is buckle-free as the sprockets engage the sprocket holes.

* * * * *